US005540614A

United States Patent [19]

Pöschl

[11] Patent Number: 5,540,614

[45] Date of Patent: Jul. 30, 1996

[54] APPARATUS FOR GRINDING WORKPIECES

[75] Inventor: Günter Pöschl, Schwaikheim, Germany

[73] Assignee: PPV - Verwaltungs-AG, Zurich, Switzerland

[21] Appl. No.: 284,459

[22] PCT Filed: Feb. 5, 1993

[86] PCT No.: PCT/EP93/00280

§ 371 Date: Aug. 5, 1994

§ 102(e) Date: Aug. 5, 1994

[87] PCT Pub. No.: WO93/15877

PCT Pub. Date: Aug. 19, 1993

[30] Foreign Application Priority Data

Feb. 6, 1992 [DE] Germany ..... 42 03 434.5

[51] Int. Cl.[6] ..... B24B 7/00; B24B 9/00

[52] U.S. Cl. ..... 451/165; 451/177

[58] Field of Search ..... 451/5, 11, 49, 451/140, 142, 143, 170, 173, 392, 394, 402, 397, 398, 163, 165

[56] References Cited

U.S. PATENT DOCUMENTS

| | | | |
|---|---|---|---|
| 3,699,719 | 10/1972 | Rozdilsky et al. | 451/165 |
| 4,369,603 | 1/1983 | Gebel et al. | 451/397 |
| 4,751,916 | 6/1988 | Bory | 451/165 |
| 4,934,103 | 6/1990 | Campergue et al. | 451/165 |
| 4,991,356 | 2/1991 | Ono | 451/24 |

FOREIGN PATENT DOCUMENTS

| | | | |
|---|---|---|---|
| 0323518 | 7/1989 | European Pat. Off. | B24B 1/04 |
| 915769 | 7/1954 | Germany . | |
| 2007218 | 6/1983 | Germany | B24B 1/04 |
| 61-61759 | 3/1986 | Japan | B24B 1/04 |
| 63-312051 | 12/1988 | Japan | B24B 1/04 |
| 405253817 | 10/1993 | Japan | 451/165 |
| 89003278 | 4/1989 | WIPO | 451/165 |

OTHER PUBLICATIONS

Magazine Article: Schleifen von Magnetlegierungen mit Hilfe von Ultraschallschwingungen by S. G. Redierko, published in Werkstattechnik–Zeitschrift für industrielle Fertigung, No. 10, p. 621, 1970.

*Primary Examiner*—Bruce M. Kisliuk
*Assistant Examiner*—Derris H. Banks
*Attorney, Agent, or Firm*—Alfred Stapler, Esq; Lipton & Stapler

[57] ABSTRACT

In a device for grinding workpieces, in particular workpieces made of ceramic materials, by means of a grinding wheel (24) or the like, the workpiece (23) is oscillated transversely to the machining direction during grinding. At least one ultrasonic transducer (1), whose ultrasonic energy is used as exciting energy for the workpiece (23), is provided as a device (20) for generating the oscillating movement of the workpiece (23). An ultrasonic resonance space (2,4) for amplitude transformation is provided between the ultrasonic transducer (1) and a sonotrode (5) which transmits the vibration to the workpiece (23).

15 Claims, 3 Drawing Sheets

APPARATUS FOR GRINDING WORKPIECES

DESCRIPTION

TECHNICAL FIELD

The invention relates to apparatus in accordance with the preamble of claim 1.

STATE OF THE ART

Apparatus of this type has previously been described in the magazine "Werkstattechnik-Zeitschrift für industrielle Fertigung" (English translation: Machine Shop Technology Magazine for Industrial Production) 60 (1970) No. 10, page 621 in the article contained therein "Schleifen von Magnetlegierungen reit Hilfe von Ultraschallschwingungen" (English translation: Grinding of Magnetic Alloys with the aid of Ultrasonic Oscillations) which will be discussed in more detail below.

It is known that the grinding of workpieces serves to achieve desired shape and dimensional precision as well as a specific surface quality or finish of the resulting workpieces, involving external circular (cylindrical) grinding, internal circular grinding, circumferential grinding, surface grinding and the like depending upon the geometric configuration and intended application of the respective workpiece.

To obtain the desired surface quality, one works with relatively high cutting speeds. However, even when using a diamond grinding wheel, there still occurs rapid wear of the grinding wheel, which significantly increases the required processing time of the workpieces. In particular, the increasing technological application of ceramic materials imposes enhanced demands upon apparatus for grinding such workpieces, because their desired shape- and dimensional precision, as well as their surface quality, are usually exceptionally high.

Such special demands arise for example in the surface treatment of ceramic sleeve bearings, especially for self-lubricated compressor pistons. There it is necessary to achieve, through an appropriate grinding process, a surface quality which ensures the formation of sliding surfaces having exceptionally low surface friction during practical application of the sleeve bearings.

From German patent (DE-PS) 915,769 there is known a machine tool in which the workpiece is set, by means of a piezoelectric or magnetostrictive ultrasonic transducer, into a high frequency oscillation during its processing, which can also be transverse to the processing direction. Through this additional oscillating motion of the workpiece, the useful life of the tools is enhanced, the processing time of the workpieces is reduced, and the surface quality of the so-treated workpieces is enhanced.

From Japanese patent abstract (JP) 63-312051A it is known, in the grinding of ceramic materials, to set the workpiece into high frequency oscillation in the direction of advance.

In Japanese patent abstract (JP) 61-61759A there is shown apparatus for the grinding of magnetic heads for video recorders, in which the workpiece is set into oscillation transversely to the processing direction by a piezoelectric ultrasonic transducer. In so doing, the movement of the piezoelectric oscillator is transmitted to the workpiece by an actuating rod. The disadvantage of this known apparatus is that the amplitude of the oscillating motion of the workpiece corresponds essentially to the amplitude of the oscillating motion of the piezoelectric oscillator and is correspondingly small.

From the above cited article "Schleifen von Magnetlegierungen mit Hilfe von Ultraschallschwingungen" (English translation: Grinding of Magnetic Alloys with the aid of Ultrasonic Oscillations) in "Werkstattechnik-Zeitschrift für industrielle Fertigung" (English translation: Machine Shop Technology Magazine for Industrial Production) an apparatus according to the preamble of claim 1 is known. In particular, magnetic alloys are ground there with the aid of ultrasonic oscillations. In so doing, the oscillation direction of the workpiece is transverse to the processing direction. The workpiece is clamped between a stationary member and an arbor, the arbor being connected to a magnetostrictive ultrasonic transducer and transmitting the oscillations to the workpiece. In this apparatus, also, it is disadvantageous that the amplitude of the oscillating motion of the workpiece corresponds essentially to the amplitude of the oscillating motion of the magnetostrictive ultrasonic transducer, and therefore is relatively small.

DESCRIPTION OF THE INVENTION

The objective of the invention is to improve apparatus according to the preamble of claim 1 so that the apparatus achieves improved grinding performance and higher, reproducible surface quality of workpieces which are to be ground.

This objective is achieved in accordance with the invention by the characterizing portions of claim 1.

In an ultrasonic resonance cavity positioned, in accordance with the invention, between an oscillation transmitter and an ultrasonic transducer there takes place an amplitude transformation of the oscillations which are generated by the ultrasonic transducer and which are passed on to the oscillation transmitter via the ultrasonic resonance cavity. By additionally configuring the oscillation transmitter as a sonotrode, there results an additional amplitude transformation. A sonotrode is capable, on the one hand, of increasing the amplitude of an ultrasonic oscillation and, on the other hand, of precisely determining the direction of the oscillation. Previously known oscillation transmitters impinged by the ultrasonic oscillations do not oscillate in a defined direction, but in multiple directions, which is undesirable for grinding because the workpiece should be set into oscillation only transversely to the processing direction. Thus, in accordance with the invention, the workpiece is set into oscillation in only one precisely defined direction with high amplitude, whereby the grinding performance of the apparatus is significantly enhanced.

By means of such oscillating motion of the workpiece which is to be ground, e.g. during external circular grinding occurring perpendicularly to the tangential velocity components of the rotating grinding wheel, which workpiece can for example also be set into rotation either in the same or in the opposite direction to the grinding wheel rotation, there is achieved for the individual abrasive grain center a resulting curvilinear path which is a sinusoidal curve. As a result, there takes place an overlap of adjoining abrasive grain paths such that no definite parallel grooves form on the workpiece surface, whereby the surface quality of the ground workpiece surface increases to an extent not achievable by conventional grinding methods.

The direction of stress on the individual abrasive grain no longer lies always in the cutting direction, but varies in the course of a period of oscillation through a predetermined stress angle. Consequently, during manufacture of ceramic sleeve bearings, for example, it follows that the sleeve bearing surfaces resulting from processing by the apparatus embodying the invention exhibit significantly fewer "rubbing surface elements" which are uniformly distributed in "island like manner" over the sleeve bearing surfaces.

In the practical application of the ceramic sleeve bearings, there are formed between the individual rubbing surfaces, surface regions resembling "gas cushions", whereby the resulting overall surface friction is substantially reduced.

The oscillation frequency which is to be produced in individual cases depends particularly upon the desired cross-sectional structure of the workpiece surface, any special workpiece characteristics, the grinding speed of the grinding wheel and the like, the oscillating motion being capable of being superposed upon a rotational movement of the workpiece relative to the grinding wheel.

The amplitude of the oscillating motion of the workpiece is usually dependent upon the specific selected cutting velocity of the grinding wheel. In general, the relationship which applies is that the amplitude is approximately equal to one half the grinding wheel displacement.

Particularly in the case of external circular grinding, the introduction of the exciting energy takes place in the axial direction into the workpiece which is to be ground and which is correspondingly supported so as to be axially moveable.

In so doing, the introduction of the exciting energy takes place preferably in the region of at least one of the end faces of the workpiece.

Advantageous embodiments of the invention are the subjects of the dependent claims.

In the advantageous embodiment of the apparatus according to the invention per claim 3, the device for producing an oscillating workpiece motion includes two ultrasonic resonance cavities which are connected to at least one ultrasonic transducer, a first resonance cavity being filled with liquid and a second resonance cavity being filled with gas, and a membrane separating the first resonance cavity from the second resonance cavity.

In so doing, per claim 4 it is particularly advantageous to use, as the device for producing an oscillating workpiece motion, an outer housing in which there are housed at least one ultrasonic transducer, the at least two ultrasonic resonance cavities, the membrane, as well as the sonotrode, the outer housing having, at its end facing away from the sonotrode, a connecting member for connection with the grinding apparatus. In particular, this connecting member can be formed in such manner as to enable fixed attachment to a tailstock or headstock of the grinding apparatus.

As a further embodiment of the apparatus according to the invention, the at least one ultrasonic transducer can be a piezoceramic transducer. For some applications, it can be desirable to place two consecutive ultrasonic transducers inside the outer housing of the device for producing an oscillating workpiece motion.

As previously mentioned, the first resonance cavity which follows essentially immediately after the one or more ultrasonic transducers is filled with 'a liquid, a prepolymeric liquid being particularly preferred. As such a prepolymeric liquid there is to be generally understood a liquid having macromolecular structure, and which exhibits a specific, predetermined surface tension. This prepolymeric liquid contained in the first resonance cavity primarily serves, so to speak, for an amplitude transformation in the selected ultrasonic frequency range which is generated by the one or more ultrasonic transducers.

As previously mentioned, under some conditions it is recommended to consecutively connect two similar, preferably piezoceramic or magnetostrictive transducers, because by so doing the desired base amplitude of the ultrasonic energy can be simply achieved. Moreover, the geometric configuration of the one or more ultrasonic transducers basically predetermines the ultrasonic frequency selected for the particular situation and depending on the application this can be in particular in the frequency range from about 50 Hz to 40 MHz.

in accordance with further advantageous embodiments of the apparatus according to the invention, the ultrasonic resonance cavities, i.e. specifically the first liquid filled resonance cavity and the second adjoining air or gas filled resonance cavity, can both be formed in the shape of a paraboloid of rotation in order to achieve the required amplitude magnification of the ultrasonic waves which are generated, with the focal point of the resulting parabolic cavity lying preferably between the membrane separating the ultrasonic resonance cavities and the plane in which at least one ultrasonic transducer is located.

For such a parabolic cavity, the parabolic wall of the liquid filled first resonance cavity in particular can be formed by a predetermined inner housing segment of an inner housing located inside the outer housing, whereas the parabolic wall of the second resonance cavity which follows the membrane and is filled with air or gas is formed by an end surface of the sonotrode.

In addition, a further advantageous embodiment of the apparatus according to the invention consists of providing, inside an additional inner housing segment of the inner housing located inside the outer housing, two, axially consecutive bearings to provide a rotatable and play-free support for the sonotrode.

In addition, this sonotrode can preferably include an end segment which protrudes from the device for producing the oscillating workpiece motion, which serves as the preferably detachable connection to an adjoining end segment of the holder for a workpiece which is to be ground.

In apparatus for grinding workpieces as described above and constructed in accordance with the present invention, there is utilized for the production of the oscillating motion of the workpiece at least one ultrasonic source, whose ultrasonic energy is utilized as the excitation energy for the workpiece. In so doing, the ultrasonic waves are preferably produced at a predetermined frequency of, for example, 1 MHz, in the prepolymeric liquid with which the first resonance cavity following the ultrasonic transducer is filled, by means of two consecutively positioned piezoceramic ultrasonic transducers. These ultrasonic waves are then transmitted to the following air filled, second resonance cavity through the membrane which is set into corresponding oscillations. The air cushion of the second resonance cavity in turn transmits the ultrasonic energy to the sonotrode which immediately adjoins the second resonance cavity and which, in essence, consists of a rod-like element of a material with high sound conductivity, for example a ceramic material or hardened steel.

The sonotrode is supported rotatably and free of play by the two associated axially consecutive bearings, the first bearing in particular being urged against the inner housing positioned inside the outer housing by means of a union (union nut), whereas the second bearing is fixed with respect to the union by means of a locking nut which is screwed onto the sonotrode, or to put it more precisely, onto the end segment of the sonotrode which protrudes from the device for producing the oscillating workpiece motion. Since, as previously mentioned, the end segment of the sonotrode is connected to an adjoining end segment of the holder for the workpiece which is to be ground, the ultrasonic energy transmitted by the sonotrode at the given frequency is transformed into corresponding oscillating motions of the following workpiece.

Because of the essentially parabolic configuration of both resonance cavities, there takes place a magnification of the amplitude of the generated ultrasonic energy in the required manner.

Excess ultrasonic energy, which is not transformed via the sonotrode into corresponding mechanical oscillations and transmitted to the workpiece, is not transformed into heat energy, by virtue of the paraboloidal shape of the second resonance cavity which immediately precedes the sonotrode and which functions in essence like a parabolic mirror, but is reflected to a focal point within the prepolymeric liquid in the first resonance cavity and then absorbed by same, whereby this prepolymeric liquid is heated.

In a further embodiment of the invention the device for producing an oscillating workpiece motion is additionally combined with at least one cooling system and associated cooling ducts in order to circulate and cool the prepolymeric liquid contained in the first ultrasonic resonance cavity, so that a constant temperature is maintained.

The invention is further explained below by means of illustrative embodiments and with reference to the accompanying drawings.

BRIEF DESCRIPTION OF THE DRAWINGS

There is shown.

PREFERRED EMBODIMENT OF THE INVENTION

Figure 1:
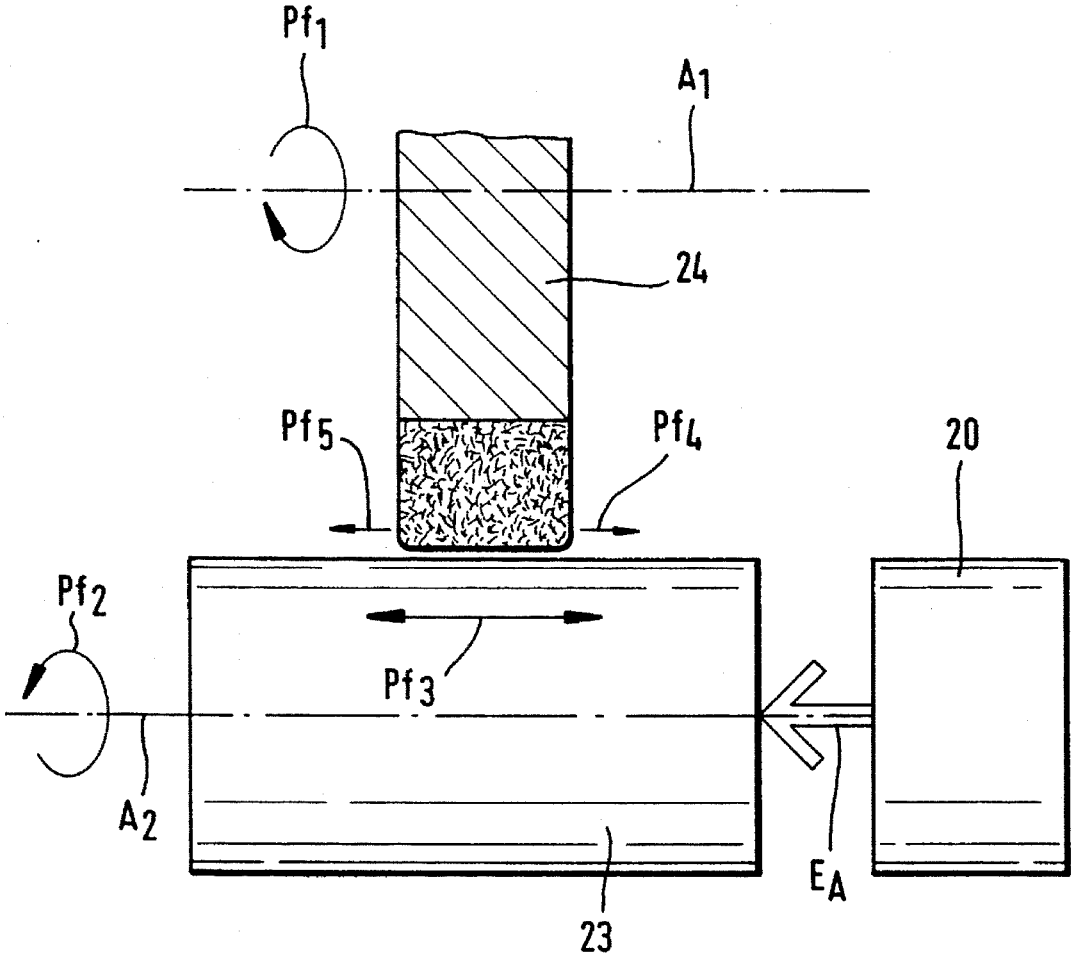
FIG. 1 diagrammatically an arrangement for the external circular grinding of a workpiece in conformity with the apparatus in accordance with the invention.

By means of FIG. 1 there is first explained the principle of external circular grinding of a workpiece 23 made of a ceramic material by means of the apparatus according to the invention. There is illustrated diagrammatically and partially a grinding wheel 24 which is arranged so as to be rotatable about a horizontal axis of rotation $A_1$ in the direction of rotation according to arrow $Pf_1$.

Specifically, the grinding wheel 24 is a diamond grinding wheel. Immediately below the grinding wheel 24 there is positioned the workpiece 23, which itself is arranged to be rotatable about an axis $A_2$ parallel to axis $A_1$, the direction of its rotation being indicated by an arrow $Pf_2$.

As can be seen, during the grinding process of the workpiece surface, the grinding wheel 24 and the workpiece 23 rotate in opposite directions with respective associated a to each other about their respective associated axis of rotation $A_1$ and $A_2$. During the rotation of the grinding wheel 24, its geometrically indeterminate cutters move at a relatively high cutting velocity relative to the workpiece 23. In so doing, the grinding wheel 24 also performs in conventional manner a pendulum movement which is represented in FIG. 1 by arrows $Pf_4$ and $Pf_5$. Through this grinding wheel pendulum movement, there is simultaneously imparted to the rotating grinding wheel 24 a kind of back and forth advance along the confronting surface of the workpiece 23 which is to be ground.

In addition, there is now positioned a device 20 opposite one of the end faces of the workpiece 23, which is in essence an oscillation generator and which serves to produce an oscillating motion of the workpiece 23 which is to be ground, relative to the cutters of the grinding wheel 24. The device 20 produces essentially an excitation energy, indicated in FIG. 1 by the arrow $E_A$, which is coupled into the workpiece 23 and thereby causes it to oscillate back and forth in the axial direction during the grinding process, corresponding to the direction of a two-headed arrow $Pf_3$. Such an oscillating motion of the workpiece 23, occurring preferably at high frequency, is in essence superposed on its rotational movement relative to the grinding wheel 24. The frequency of the oscillating workpiece motion is preferably selected from a frequency range of between 50 Hz and 40 MHz. The amplitude of this oscillating workpiece motion is so adjusted as to correspond to about half the displacement of the grinding wheel 24 due to its pendulum movement during the grinding process.

The device 20 for producing an oscillating workpiece motion involves preferably an ultrasonic source whose ultrasonic energy is used as the excitation energy $E_A$ for the workpiece 23, as is further explained below with reference to FIGS. 2 and 3.

Figure 2:
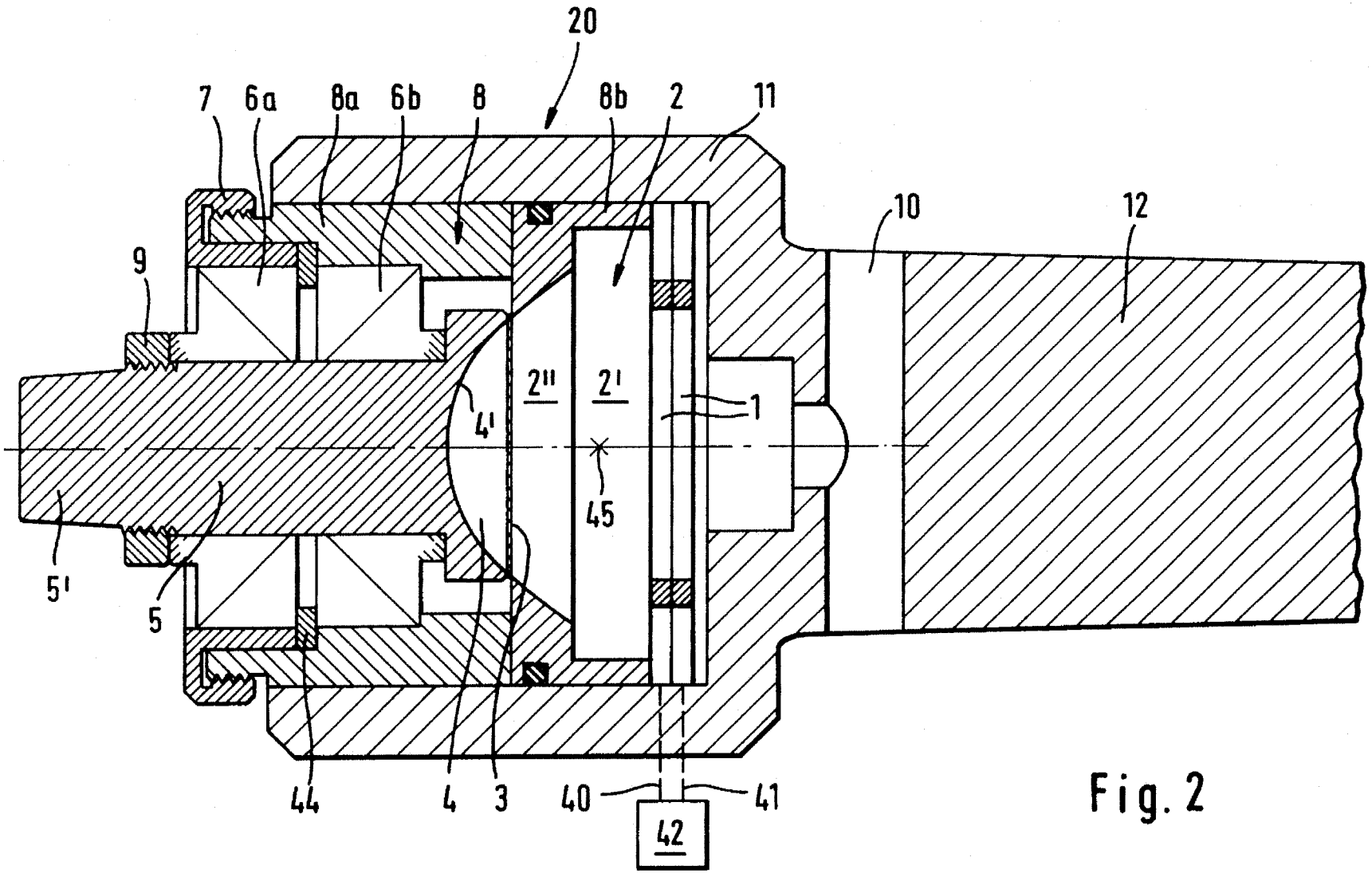
FIG. 2 diagrammatically a cross-sectional view of a device for producing an oscillating motion in, a workpiece which is to be ground.

FIG. 2 shows a preferred illustrative embodiment of the device, collectively designated by reference numeral 20, for producing an oscillating motion of the workpiece 23 according to FIG. 1 relative to the cutters of the grinding wheel.

Thus the device 20 of FIG. 2 corresponds essentially to the device 20 of FIG. 1, this device 20 being positioned in practice in the region of clamping of workpiece 23 inside a grinding machine (see also FIG. 2).

Figure 3:
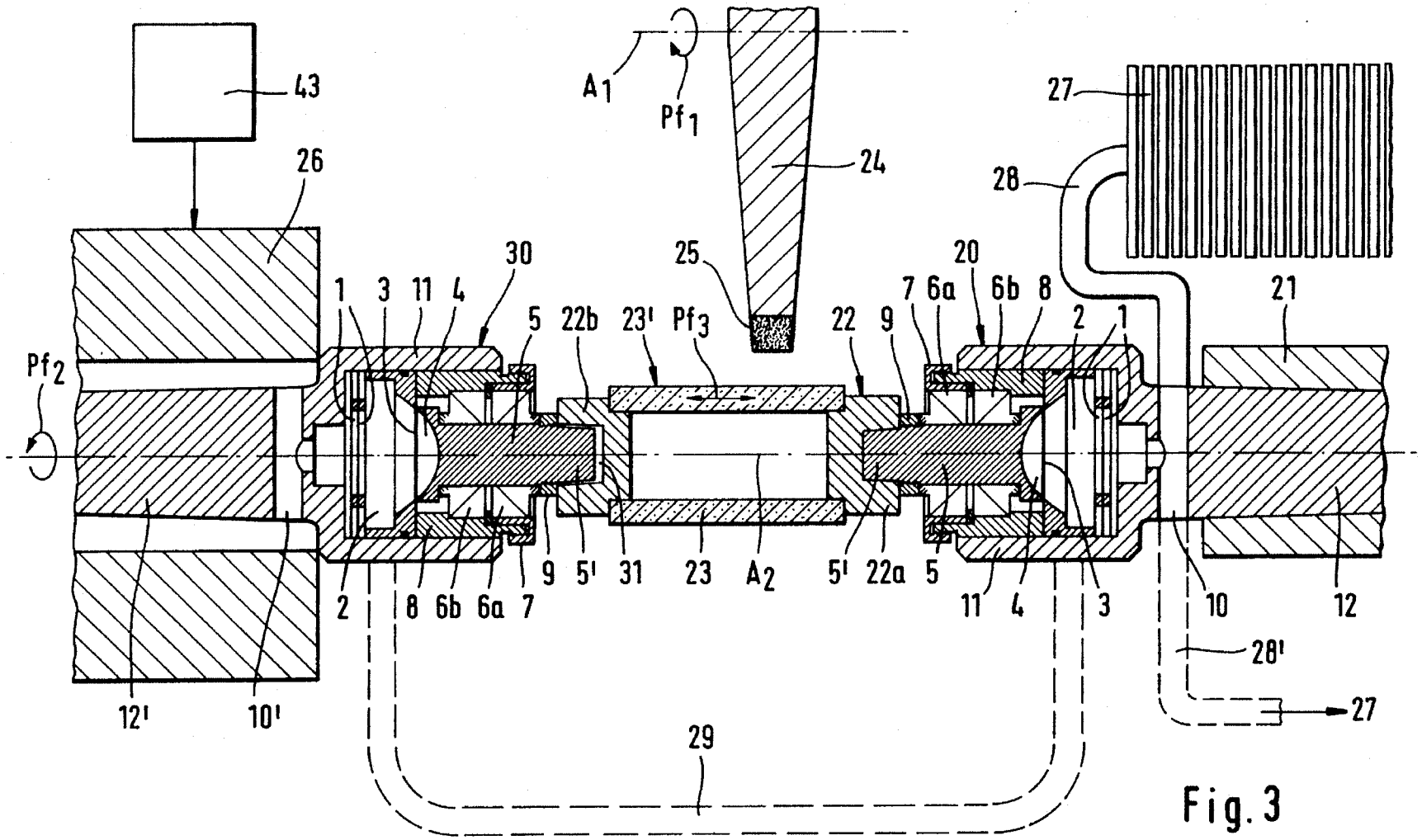
FIG. 3 diagrammatic partial cross-sectional view of apparatus for external circular grinding in accordance with the invention in which, on both sides of a workpiece clamped between tailstock and headstock, there is a device corresponding to the device of FIG. 2 for producing an oscillating workpiece motion.

The device 20 illustrated in FIG. 2 for producing an oscillating workpiece motion includes in substance a cylindrical outer housing 11 which contains the following components:

Two ultrasonic transducers 1 located immediately next to each other, preferably in the form of piezoceramic ultrasonic transducers, adjoining these a first ultrasonic resonance cavity 2, consisting of two partial resonance cavities 2' and 2", a second ultrasonic resonance cavity 4 adjoining the partial resonance cavity 2", a membrane 3 which separates the first resonance cavity 2 from the second resonance cavity 4, as well as a sonotrode 5, which immediately adjoins at one end the second resonance cavity 4 and at the other end is adapted to be connected to a holder 22 shown in FIG. 3 for the workpiece 23. In a region facing away from sonotrode 5, the other housing 11 extends into a connecting member 12 of substantially rod shaped configuration which serves to connect the device 20 with the tailstock or headstock of a grinding machine, as is further described in detail below with reference to FIG. 2.

In the interior of outer housing 11 there is slidably located an inner housing 8 having two inner housing segments 8*a* and 8*b*. The membrane 3 is clamped essentially between these two inner housing segments 8*a* and 8*b* and is glued to the inner housing segment 8*b*. The first resonance cavity 3 with its partial resonance cavities 2' and 2" which is immediately next to the two piezoceramic ultrasonic transducers 1 is filled with a prepolymeric liquid, whereas the second resonance cavity 4 which is next to the membrane 3 contains only air. The prepolymeric liquid contained in the first resonance cavity 2 is a liquid with macromolecular structure, which primarily provides an amplitude transformation in the ultrasonic frequency range generated by the two piezoceramic ultrasonic transducers 1. By specific geometric configuration of the two piezoceramic ultrasonic transducers 1 the ultrasonic frequency required in a particular practical application is predetermined, for example at a frequency of 1 MHz. As diagrammatically illustrated in FIG. 2, the two piezoceramic ultrasonic transducers 1 are respectively connected via connections 40 and 41 to an electrical voltage source 42, the respective applied voltage being, for example, 2,000 volts. The piezoceramic ultrasonic transducers 1 are thereby excited to oscillate in the ultrasonic range, the amplitude per transducer being 0.023 mm.

As can be further seen from FIG. 2, the two consecutive first and second ultrasonic resonance cavities 3 and 4 collectively have substantially the shape of a paraboloid of rotation, a focal point 45 of the resulting parabolic resonance cavity lying preferably between membrane 3 and the piezoelectric transducers 1. By virtue of this parabolic cavity shape there is achieved the required amplitude magnification of the ultrasonic waves produced by the piezoceramic ultrasonic transducers 1. Whereas the parabolic wall of the first resonance cavity 2, or more precisely the parabolic partial wall of the partial resonance cavity 2", is formed by the inner housing segment 8*b*, the adjoining parabolic wall 4' of the second resonance cavity 4 is formed by the adjoining end face of sonotrode 5.

Sonotrode 5, which is substantially rod shaped and rotationally symmetrical, is supported within the inner housing 8 of device 20 in a manner which is, on the one hand, rotatable and, on the other hand, free of play. To that end there are provided within the inner housing segment 8*a* two axially consecutive bearings, namely, viewed in the direction from right to left in FIG. 2, a first bearing 6*b* as well as a second bearing 6*a*, which are separated from each other by a spacing or sealing ring 44 located inside the inner housing segment 8*a*. The first bearing 6*b* is pressed against this inner housing segment 8*a* by a union nut 7 which can be screwed onto inner housing segment 8*a* from outside, whereas the second bearing 6*a* is affixed to the union nut 7 by means of a locking nut 9 which can be screwed onto the sonotrode 5 and particularly onto the end segment 5' of the sonotrode 5 which protrudes to the left from device 20.

As can be seen in more detail in FIG. 3, the end segment 5' of sonotrode 5 is connected to a corresponding end portion 22*a* of a holder 22 for the workpiece 23 to be processed, e.g. in detachable manner.

Due to this connection, the ultrasonic energy transmitted by the sonotrode 5 at the given frequency is transformed into corresponding oscillating motions of the workpiece 23 as represented by two headed arrow $Pf_3$. On the other hand, the excess ultrasonic energy which is not transformed by the sonotrode into corresponding mechanical oscillations and transmitted to the workpiece 23, is not transformed into heat energy due to the parabolic configuration of both resonance cavities 2 and 4, and particularly because of the paraboloidal shape of the air filled resonance cavity 4 which is connected directly ahead of the sonotrode 5, but is reflected to a focal point, for example to the focal point 45 within the prepolymeric liquid in the first resonance cavity 2, and is then absorbed by that liquid which is thereby heated. However, so that a constant temperature of this liquid can be maintained, special cooling means are provided. These consist specifically in that the device 20, as can also be seen in FIG. 3, is connected to the cooling system 27 via in- and outlet ducts 10 as well as through connecting conduits 28 and 28', so that the prepolymeric liquid contained in the first ultrasonic resonance cavity 2 can be continuously circulated and cooled (liquid flow 4 l/min, for example).

In FIG. 3 there is further diagrammatically illustrated a complete grinding machine which serves for the outer circular grinding of the above-mentioned workpiece 23 of ceramic material, the workpiece surface being designated by 23'. For material removal there is used the rotatably supported diamond grinding wheel 24 which can be set into rotation about its axis $A_1$ in the direction of rotation according to arrow $Pf_1$.

As a result, the geometrically indeterminate cutters 25 of the diamond grinding wheel 24 move with a predetermined high cutting velocity of, for example, 30 m per second relative to the workpiece 23. Simultaneously, as already explained with reference to FIG. 1, the workpiece 23 is set into oscillating motion according to two headed arrow $Pf_3$ during the grinding process. To make this possible, tailstock 21 of the grinding machine according to FIG. 3 is connected to a first device 20 for producing the oscillating motion of the workpiece 23 and in addition the workpiece holder 22 is connected with the first device 20 on the one hand and with the second device 30 on the other hand.

Both of the above-mentioned devices 20 and 30 for producing the oscillating motion of the workpiece 23 completely correspond in their construction to the device 20 which has previously been illustrated and described in FIG. 2. Therefore all corresponding components of the two devices 20 and 30 have been designated with the same reference numerals. The two devices 20 and 30 are so positioned in the grinding apparatus according to FIG. 3 that, on the one hand, the left-extending end segment 5' of sonotrode 5 of the first device 20 is fixedly connected to an adjoining segment 22*a* of the workpiece holder 22, while, on the other hand, on the opposite side of the workpiece holder 22 the end segment 5' of sonotrode 5 of the second device 30 is inserted into its adjoining end segment 22*b* of the workpiece holder 22 with play, in order to permit relative movements.

To this end there is provided in end segment 22*b* of the workpiece holder 22 a recess 31 so dimensioned that rotation relative to the end segment 5' of sonotrode 5, becomes possible, as well as some axial displacements of the workpiece holder 22 together with workpiece 23 in the direction of axis $A_2$.

The excitation of the piezoceramic ultrasonic transducers 1 included in both devices 20 and 30 takes place in each case via corresponding accompanying voltage supplies, for simplicity not represented in FIG. 3, care being taken by means of appropriate circuitry that the energizing takes place with a phase displacement of $\pi$ between the piezoceramic ultrasonic transducers 1 on both sides in the respective devices 20 and 30.

In this way, the respective ultrasonic excitation energy is transmitted to the sonotrodes 5 on both sides in devices 20 and 30 with appropriate phase displacement, so that the oscillating directions of the ultrasonic energy in the oppositely located, identical devices 20 and 30 are synchronized with each other.

In FIG. 3 it is further diagrammatically shown that the headstock 26 of the grinding apparatus is coupled to a drive assembly 43 so that the headstock 26 can be set into rotation in the direction of rotation indicated by arrow $Pf_2$. The outer housing 11 of the second device 30 on the left side in FIG. 3 is again provided with a connecting means 12' which serves to connect the device 30 fixed for rotation to the headstock 26.

Similarly, on the opposite side, the outer housing 11 of the first device 20 is fixedly connected to tailstock 21 via the adjoining connecting means 12.

On the left side of workpiece holder 22, the end segment **22*b* which is located there is coupled to the second device 30 which is located there via a turning moment transmitter (not shown), for which purpose there is provided in particular a "driving dog" (not shown in FIG. 3) in such manner that the workpiece holder 22 can turn together with the outer housing 11 of the second device 30 when the headstock 26 is set into corresponding rotation. By means of the rotary drive of headstock 26 there are therefore achieved the following rotating movements in the grinding apparatus according to FIG. 3**:

Rotation of the outer housing 11 of the second device 30 which is shown on the left side, namely relative to the sonotrode 5 rotatably supported in its interior; rotation of the workpiece holder 22 including workpiece 23 connected to device 30 via the driving dog; rotation of the sonotrode 5 of first device 20 which is fixedly connected to the right hand end segment **22*a* of workpiece holder 22, this sonotrode 5 being freely rotatable in relation to its associated outer housing 11 of the first device 20, as previously explained in detail with reference to FIG. 2**.

Because the outer housing 11 of the first device 20 on the right hand side of FIG. 3 is fixedly connected to the stationary tailstock 21 of the grinding apparatus, the supply connections and the like can readily be brought out from this outer housing 11.

In particular, provision is made for externally cooling the liquid contained in the first resonance cavity 2 of the first device 20, for which purpose the required liquid circulation can be carried out through in- and outlet ducts 10 provided in housing 11 and appropriately accompanying connecting conduits 28 and 28' which lead to cooling system 27. Corresponding liquid in- and outlet ducts 10' are also provided in the second device 30 located on the opposite side.

In contrast to the embodiment of the grinding apparatus illustrated in FIG. 3, a modification can also be provided in which the second device 30 located on the left hand side does not have any ultrasonic transducers 1 for producing the oscillating motion of the workpiece 23, but in its place there is provided a connecting conduit 29 between the respective liquid filled resonance cavities 2 of the first device 20 and the second device 30. In this way, the resonance liquids in the devices 20 and 30 on both sides are permanently connected to each other so that the ultrasonic excitation energies produced by the ultrasonic transducers 1 in the first device 20 can be transmitted through the liquid contained in conduit 29 into the resonance cavity 2 in the second device 30.

In view of a $\lambda/2$ phase displacement which is occasioned by the attenuation within the liquid, the connecting conduit 29 is so dimensioned that the time delay yields a relative ultrasonic phase displacement of $\pi$ in such manner that the first device 20 and the second device 30 are appropriately controllable in phase displacement, similarly to the embodiment previously described.

In contrast to the embodiments of the apparatus according to FIG. 3 described above, a further modification can be provided in such manner that, in place of the second device 30 for producing an oscillating motion of workpiece 23 there is provided an electromagnetic moving coil which is connected to the workpiece holder 22 on the one hand and to headstock 26 on the other hand.

In the case of such a modification, a device 20 for producing an oscillating motion of workpiece 23 as explained with reference to FIG. 2 is present only on the right hand side.

Moreover, there also exists the possibility that, in the grinding apparatus according to FIG. 3, the first device 20 and/or the second device 30 for producing the oscillating motion of workpiece 23 is replaced by a magnetostrictive oscillator. In the case of such a modification of the apparatus according to FIG. 3, the tailstock 21, for example, can be connected to a first magnetostrictive oscillator and the headstock 26 to a second similar oscillator. Furthermore the workpiece holder 22 is then connected to the first magnetostrictive oscillator on the one hand and to the second oscillator on the other hand, in such a manner that the workpiece 23 retained in the holder 22 is again set into oscillations in the region between the tailstock 21 and the headstock 26, in a manner similar to that previously explained with reference to FIGS. 1 and 3.

The present invention can also be applied not only to external circular grinding, but also to plane surface grinding, for example, or to linear grinding especially of workpieces made of ceramic material.

I claim:

1. Apparatus for grinding a workpiece, having at least one device for producing an oscillating motion of the workpiece relative to a grinding wheel, wherein the at least one device includes at least one ultrasonic transducer and an oscillation transmitter located between ultrasonic transducer and workpiece, characterized in that the oscillation transmitter is a sonotrode and that at least one ultrasonic resonance cavity is located between the at least one ultrasonic transducer and the sonotrode by which the transducer oscillation is amplified on its way to the sonotrode.

2. Apparatus according to claim 1 characterized in that the at least one ultrasonic transducer is a piezoceramic or magnetostrictive transducer.

3. Apparatus for grinding a workpiece, having at least one device for producing an oscillating motion of the workpiece relative to a grinding wheel, wherein the at least one device includes at least one ultrasonic transducer and an oscillation transmitter located between ultrasonic transducer and workpiece, characterized in that the oscillation transmitter is a sonotrode and in that a first and a second ultrasonic resonance cavity is located between the at least one ultrasonic transducer and the sonotrode, a membrane separates the first and second resonance cavity from each other and the first resonance cavity is liquid and the second resonance cavity is air- or gas-filled.

4. Apparatus according to claim 3, characterized by an outer housing, in which the at least one ultrasonic transducer, the ultrasonic resonance cavities, the membrane as well as the sonotrode are housed, the outer housing having at its end facing away from the sonotrode a connecting member for connection with the grinding apparatus.

5. Apparatus according to claim 4, characterized in that two ultrasonic transducers are positioned consecutively within the outer housing.

6. Apparatus according to claim 4 characterized in that a parabolic wall of the first resonance cavity is formed by a first inner housing segment of an inner housing positioned within the outer housing and that a parabolic wall of the second resonance cavity is formed by an end surface of the sonotrode.

7. Apparatus according to claim 6 characterized in that, within a second inner housing segment of the inner housing located inside the outer housing there are provided bearings located consecutively in the axial direction for rotatable and play-free retention of the sonotrode.

8. Apparatus according to claim 3, characterized in that the first resonance cavity is filled with a prepolymeric liquid.

9. Apparatus according to claim 3, characterized in that the ultrasonic resonance cavities are collectively shaped at least partially in the manner of a paraboloid of rotation, in order to achieve an amplitude magnification of the produced ultrasonic waves, and the focal point of the paraboloid of rotation lies between the membrane and the at least one ultrasonic transducer.

10. Apparatus for the grinding of workpieces, and particularly an external circular grinding apparatus having at least one device for producing an oscillating motion of the workpiece relative to a grinding wheel, wherein the at least one device includes at least one ultrasonic transducer and an oscillation transmitter located between ultrasonic transducer and workpiece, characterized in that the oscillation transmitter is a sonotrode and that at least one ultrasonic resonance cavity is located between the at least one ultrasonic transducer and the sonotrode, said apparatus being further characterized by the combination of the following features:

a) a tailstock which is connected to a first device for producing an oscillating motion of the workpiece, which includes said at least one ultrasonic transducer and said oscillation transmitter located between ultrasonic transducer and workpiece b) a headstock which is connected to a second device for producing an oscillating motion of the workpiece which has the same construction as the first device; and c) a workpiece holder which is connectable to the first device on the one hand and to the second device on the other hand whereby the workpiece retained in the holder can be set into oscillation in the region between the tailstock and the headstock.

11. Apparatus according to claim 10 characterized in that, as the second device for producing an oscillating workpiece motion, there is provided, replacing the ultrasonic transducer, a connecting conduit between the liquid filled resonance cavities of the first device and the second device.

12. Apparatus according to claim 11, characterized in that the connecting conduit is so dimensioned that it provides a transit time delay corresponding to a relative ultrasound phase displacement of $\pi$, so that the first device and the second device are appropriately controllable with respect to phase displacement.

13. Apparatus according to claim 10 characterized in that, in place of the second device for producing an oscillating motion of the workpiece, there is provided an electromagnetic solenoid which is connected to the holder on the one hand and to the headstock on the other hand.

14. Apparatus for grinding a workpiece, having at least one device for producing an oscillating motion of the workpiece relative to a grinding wheel, wherein the at least one device includes at least one ultrasonic transducer and an oscillation transmitter located between ultrasonic transducer and workpiece, characterized in that the oscillation transmitter is a sonotrode and that at least one ultrasonic resonance cavity is located between the at least one ultrasonic transducer and the sonotrode, and in that the at least one device is combined with at least one cooling system and associated cooling ducts for circulating and cooling of liquid contained in the ultrasonic resonance cavity.

15. Apparatus for grinding a workpiece, having at least one device for producing an oscillating motion of the workpiece relative to a grinding wheel, wherein the at least one device includes at least one ultrasonic transducer and an oscillation transmitter located between ultrasonic transducer and workpiece, characterized in that the oscillation transmitter is a sonotrode, that at least one ultrasonic resonance cavity is located between the at least one ultrasonic transducer and the sonotrode, and that the sonotrode has an end segment which protrudes from the at least one device which serves as a preferably detachable connection to an associated end segment of a holder for the workpiece.

* * * * *